US010449566B2

(12) United States Patent
Ikushima

(10) Patent No.: US 10,449,566 B2
(45) Date of Patent: Oct. 22, 2019

(54) LIQUID MATERIAL DISCHARGE APPARATUS

(71) Applicant: MUSASHI ENGINEERING, INC., Mitaka-shi, Tokyo (JP)

(72) Inventor: Kazumasa Ikushima, Tokyo (JP)

(73) Assignee: MUSASHI ENGINEERING, INC., Tokyo (JP)

( * ) Notice: Subject to any disclaimer, the term of this patent is extended or adjusted under 35 U.S.C. 154(b) by 354 days.

(21) Appl. No.: 15/537,604

(22) PCT Filed: Jan. 14, 2016

(86) PCT No.: PCT/JP2016/050922
§ 371 (c)(1),
(2) Date: Jun. 19, 2017

(87) PCT Pub. No.: WO2016/117437
PCT Pub. Date: Jul. 28, 2016

(65) Prior Publication Data

US 2018/0264506 A1 Sep. 20, 2018

(30) Foreign Application Priority Data

Jan. 19, 2015 (JP) ..... 2015/007834

(51) Int. Cl.
*B05C 11/10* (2006.01)
*B05C 11/11* (2006.01)
(Continued)

(52) U.S. Cl.
CPC ..... *B05C 11/10* (2013.01); *B05C 5/00* (2013.01); *B05C 5/02* (2013.01); *B05C 11/11* (2013.01); *B05C 13/00* (2013.01)

(58) Field of Classification Search
None
See application file for complete search history.

(56) References Cited

U.S. PATENT DOCUMENTS 6,761,769 B2 7/2004 Inaba et al.
2002/0112821 A1 8/2002 Inaba et al.
(Continued)

FOREIGN PATENT DOCUMENTS

JP 09-181434 A 7/1997
JP 2002-239435 A 8/2002
(Continued)

*Primary Examiner* — Jethro M. Pence
(74) *Attorney, Agent, or Firm* — Westerman, Hattori, Daniels & Adrian, LLP

(57) ABSTRACT

In a liquid material discharge apparatus, attachment/detachment of a liquid contact unit (2) and a main body unit (15) is more safely and easily performed. The apparatus includes the liquid contact unit (2) provided with a housing (6) including a nozzle (3) and a discharge member (5), and with a storage container (4) fluidly connected to the housing with the aid of a mounting member, and a main body unit provided with a holder (19) to which the housing is detachably attached, and with a drive unit (16) for actuating the discharge member that is detachably coupled to the drive unit, the apparatus further includes a movable member (12) being movable in an up-down direction along the housing while the movable member remains attached to the housing, and the discharge member and the drive unit are attachable with movement of the movable member in the up-down direction.

11 Claims, 12 Drawing Sheets

(51) Int. Cl.

| | |
|---|---|
| ***B05C 13/00*** | (2006.01) |
| ***B05C 5/02*** | (2006.01) |
| ***B05C 5/00*** | (2006.01) |

(56) References Cited

U.S. PATENT DOCUMENTS

2004/0134996 A1* 7/2004 Kazumasa ..... B05B 1/083 239/11
2005/0061391 A1* 3/2005 Ikushima ..... B05C 5/02 141/2
2005/0063839 A1* 3/2005 Kazumasa ..... B05C 5/0225 417/415
2009/0120357 A1* 5/2009 Ikushima ..... B05C 5/02 118/300
2009/0236366 A1* 9/2009 Ikushima ..... B05C 5/0229 222/135
2010/0052198 A1* 3/2010 Ikushima ..... H01L 21/563 264/40.4
2010/0057251 A1* 3/2010 Ikushima ..... B25J 9/1674 700/245
2010/0075021 A1* 3/2010 Ikushima ..... H01L 21/563 427/9
2010/0103229 A1* 4/2010 Ikushima ..... B41J 2/16552 347/85
2010/0175759 A1* 7/2010 Ikushima ..... G02F 1/1303 137/15.01
2010/0177138 A1* 7/2010 Ikushima ..... B05C 5/0225 347/19
2010/0181337 A1* 7/2010 Ikushima ..... B05C 5/0225 222/1
2010/0224071 A1* 9/2010 Ikushima ..... B01D 19/0036 96/194
2011/0045167 A1* 2/2011 Ikushima ..... B05C 11/1005 427/8
2012/0097097 A1* 4/2012 Ikushima ..... B05B 3/026 118/300
2012/0145743 A1* 6/2012 Ikushima ..... B05C 5/0225 222/1
2012/0217262 A1* 8/2012 Ikushima ..... B05C 5/0225 222/1
2012/0313276 A1* 12/2012 Ikushima ..... H01L 21/563 264/40.1
2013/0108521 A1* 5/2013 Ikushima ..... B01L 3/0265 422/509
2014/0252041 A1* 9/2014 Ikushima ..... B65D 83/0005 222/309
2014/0346253 A1* 11/2014 Ikushima ..... F04B 17/044 239/337
2014/0376328 A1* 12/2014 Ikushima ..... B01F 13/0863 366/191
2015/0182981 A1* 7/2015 Ikushima ..... B05B 15/557 134/22.12
2015/0246368 A1* 9/2015 Ikushima ..... B05C 11/1002 118/323
2016/0023232 A1* 1/2016 Ikushima ..... B05C 5/0225 427/421.1
2017/0066005 A1* 3/2017 Ikushima ..... B05C 5/0212
2017/0225188 A1* 8/2017 Ikushima ..... B05C 5/02
2018/0208390 A1* 7/2018 Ikushima ..... B05C 5/00
2018/0264506 A1* 9/2018 Ikushima ..... B05C 11/11

FOREIGN PATENT DOCUMENTS

JP 5089969 B2 12/2012
JP 2013-52350 A 3/2013

* cited by examiner

LIQUID MATERIAL DISCHARGE APPARATUS

TECHNICAL FIELD

The present invention relates to an apparatus for discharging a liquid in a fixed amount, and more particularly to a liquid material discharge apparatus including a mechanism that enables a liquid contact unit and a main body unit to be held in a state separated from or joined to each other.

The term "discharge" used in the present invention includes a discharge method of the type that a liquid material comes into contact with a workpiece before departing from a discharge port, and a discharge method of the type that a liquid material comes into contact with a workpiece after departing from a discharge port.

BACKGROUND ART

Regarding techniques for discharging a liquid material, such as an adhesive, onto a substrate, there is known, as the screw type, a method of rotating a screw, for example, which includes a spiral blade formed on a surface of a rod-like member extending in an axial direction, and of feeding the liquid material by the blade with rotation of the screw to be discharged. Such a method is widely used in particular to discharge a high-viscous liquid material and a liquid material containing filler.

With respect to a screw type discharge apparatus, Patent Reference 1, for example, discloses a viscous material application apparatus including a syringe that stores a viscous material; a pressurizing device that pressurizes an inner space of the syringe; a viscous material application member that receives and guides the viscous material pneumatically fed under pressurization; a viscous material supply tube that connects the syringe and the viscous material application member to each other, and that allows the viscous material to pass therethrough for supply of the viscous material to the viscous material application member from the syringe; a discharge shaft that is a rod-like member fitted into a hollow portion extending through the viscous material application member in a lengthwise direction, and that includes, at its one end, a screw portion for feeding the viscous material, which is guided by the viscous material application member, in an axial direction under pressurization with rotation of the discharge shaft about an axis thereof; a nozzle that discharges the viscous material, which is fed under pressurization with the rotation of the discharge shaft, to the outside; a rotation mechanism that rotates the nozzle about a nozzle axis; an application target holder that holds an application target in a restricted state; and a controller, the viscous material discharge apparatus being operated, under control by the controller, in a manner of moving one or both of the nozzle and application target holder for relative positioning, and of moving the nozzle downward to apply a fixed amount of the viscous material discharged from the nozzle to a predetermined position on the application target, wherein the viscous material supply tube is joined to the viscous material application member in a state rotatable together with the viscous material application member.

Furthermore, Patent Reference 2 discloses a creamy solder application apparatus wherein a motor having a rotation shaft provided with a first connecting member at an end thereof is mounted to a base with the first connecting member positioned on the lower side, a pump unit is constituted by a screw provided with a second connecting member of which one end engaged with the first connecting member, and by a cylinder that accommodates the screw, and that has a creamy solder inlet formed in a lateral portion through which a creamy solder flows into the cylinder from the outside, an insertion hole is formed in the base as a through-hole being coaxially with the rotation axis and having a diameter enough to accommodate the cylinder, and the cylinder is accommodated in the insertion hole in a state not rotatable, but movable in the axial direction.

Moreover, Patent Reference 3 discloses a paste discharge apparatus comprising a main body that includes a liquid chamber opened at an upper end and having a circular sectional shape, and a nozzle that ejects a paste in the liquid chamber, a syringe that stores the paste supplied to the liquid chamber, and a gas supply unit that supplies pressurized gas into the syringe, wherein the main body is constituted such that a screw for feeding the paste to the nozzle when driven to rotate is detachably mounted into the liquid chamber, and that a lid member for closing an opening of the liquid chamber is detachably attached in a state where the screw is demounted.

In addition, the applicant has proposed a liquid material discharge apparatus comprising a liquid contact unit including a nozzle, a storage container, and a discharge member, which are integrally constituted with the aid of a housing, and a main body unit including a holder provided with a support member to which the housing is attached, and a drive unit that operates the discharge member, the liquid contact unit and the main body unit being attachable and detachable by constituting the discharge member and the drive unit to be attachable and detachable with a coupling member and by constituting the housing and the holder to be attachable and detachable, wherein the housing is horizontally movable in a state supported by the support member to be attached to and detached from the holder, and the discharge member and the drive unit are attachable and detachable with vertical movement of the housing while the housing is held in the state attached to the holder (Patent Reference 4).

CITATION LIST

Patent References

Patent Reference 1: Japanese Patent Laid-Open Publication No. 2002-239435

Patent Reference 2: Japanese Patent Laid-Open Publication No. H09-181434

Patent Reference 3: Japanese Patent Laid-Open Publication No. 2013-52350

Patent Reference 4: Japanese Patent No. 5089969

SUMMARY OF INVENTION

Technical Problem

The liquid material discharge apparatus is usually mounted to an automatic machine (XYZ robot) that is movable relative to a workpiece for the purpose of applying the liquid material in a desired pattern onto the workpiece. When operations of replacing consumables, such as the liquid material and the nozzle, and maintenance work are performed on the discharge apparatus, accidents of falling of parts, component units, etc. of the discharge apparatus onto workpieces occur in not a few cases. Those accidents may damage not only the fallen component units, but also the workpieces, robot drivers, and tables on which the workpieces are placed.

In any of the inventions disclosed in Patent References cited above, the liquid contact unit is constituted to be attachable and detachable. In the apparatuses other than that disclosed in Patent Reference 4 proposed by the applicant (namely, in the apparatuses disclosed in Patent References 1 to 3), however, no considerations are paid to measures for coping with the accidents of falling of the parts, the component units, etc. during maintenance work.

Although the invention disclosed in Patent Reference 4 proposed by the applicant takes measures for the above-described accidents of falling and has achieved a certain level of effect, it accompanies with a problem of needing practical experiences to perform the attaching and detaching operations. Furthermore, parts to be fastened and unfastened, such as screw nails, are needed to fix the liquid contact unit, and a risk of falling of the parts still remains. Moreover, a width of the entire apparatus is increased due to a structure that a widest portion of the liquid contact unit is inserted into a recessed portion of the holder.

In view of the situations described above, an object of the present invention is to provide a liquid material discharge apparatus in which attachment/detachment of a liquid contact unit and a main body unit can be more safely and easily performed.

Solution to Problem

The liquid material discharge apparatus according to the present invention comprises a liquid contact unit provided with a housing including a nozzle and a discharge member, and with a storage container fluidly connected to the housing with the aid of a mounting member, and a main body unit provided with a holder to which the housing is detachably attached, and with a drive unit for actuating the discharge member that is detachably coupled to the drive unit, wherein the liquid material discharge apparatus further comprises a movable member being movable in an up-down direction along the housing while the movable member remains attached to the housing, and the discharge member and the drive unit are attachable and detachable with movement of the movable member in the up-down direction.

In the above liquid material discharge apparatus, the housing may include a lower housing portion having a shoulder, and an upper housing portion having a smaller width than the lower housing portion, and the liquid contact unit may be fixed to the main body unit with the movable member and the shoulder gripping the holder therebetween in a sandwiched relation. In this connection, preferably, the movable member is formed of a flat-plate member having a through-hole into which the upper housing portion is inserted. More preferably, a width of the movable member is not larger than a width of the holder. Even more preferably, an external thread zone is formed in an outer peripheral surface of the upper housing portion, an internal thread zone engageable with the external thread zone is formed in an inner peripheral surface of the through-hole of the movable member, and the discharge member and the drive unit are attachable and detachable with actions of the external and internal thread zones by rotating the movable member forward and backward.

In the above liquid material discharge apparatus including the upper housing portion and the lower housing portion, the holder may include a pair of support arms, and a width of the movable member may be larger than a distance between the pair of support arms. In that case, preferably, the holder includes an upper holder portion and a lower holder portion, a spacing between the pair of support arms has a distance, at a position present in the upper holder portion, smaller than a width of the lower housing portion and a distance, at a position present in the lower holder portion, larger than the width of the lower housing portion, and the liquid contact unit is fixed to the main body unit with the movable member and the shoulder gripping the upper holder portion therebetween in a sandwiched relation. More preferably, each of the upper housing portion and the lower housing portion has a circular columnar shape, and the holder includes a connecting surface that has a circular-arc shape, and the connecting surface connects the upper holder portion and the lower holder portion to each other.

In the above liquid material discharge apparatus including the upper housing portion and the lower housing portion, the lower housing portion may have a rectangular-columnar shape.

An application apparatus according to the present invention comprises the above liquid material discharge apparatus, a compressed gas source that supplies compressed gas for applying pressure to a liquid stored in the storage container, a discharge control unit that controls the drive unit of the liquid material discharge apparatus and gas pressure in the compressed gas source, a worktable on which an application target is placed, an XYZ drive mechanism that moves the liquid material discharge apparatus and the worktable relatively, and a drive control unit that controls operations of the XYZ drive mechanism.

Another application apparatus according to the present invention comprises the above liquid material discharge apparatus including the upper housing portion and the lower housing portion, a compressed gas source that supplies compressed gas for applying pressure to a liquid stored in the storage container, a discharge control unit that controls the drive unit of the liquid material discharge apparatus and gas pressure in the compressed gas source, a worktable on which an application target is placed, an XYZ drive mechanism that moves the liquid material discharge apparatus and the worktable relatively, and a drive control unit that controls operations of the XYZ drive mechanism.

Advantageous Effects of Invention

The following advantageous effects can be obtained with the present invention.

(1) Since parts to be fastened and unfastened, such as screw nails, and tools for fastening and unfastening are not needed to fix the liquid contact unit, damages of workpieces, etc. caused by falling parts or tools can be prevented.

(2) Since the liquid contact unit is attached in a state where the movable member is supported by the holder upper surface, the liquid contact unit can be prevented from falling during an operation of inserting the holder.

(3) In the configuration including the external and internal thread zones, the liquid contact unit and the main body unit can be attached to and detached from each other with the actions of the external and internal thread zones by rotating the movable member forward and backward. Therefore, even a first-time operator can easily perform the attachment/detachment.

(4) Since the liquid contact unit is held at its part having a relatively small width by the holder, an overall width of the apparatus can be reduced.

DESCRIPTION OF EMBODIMENTS

Embodiments for implementing the present invention will be described below.

First Embodiment

Figure 1:
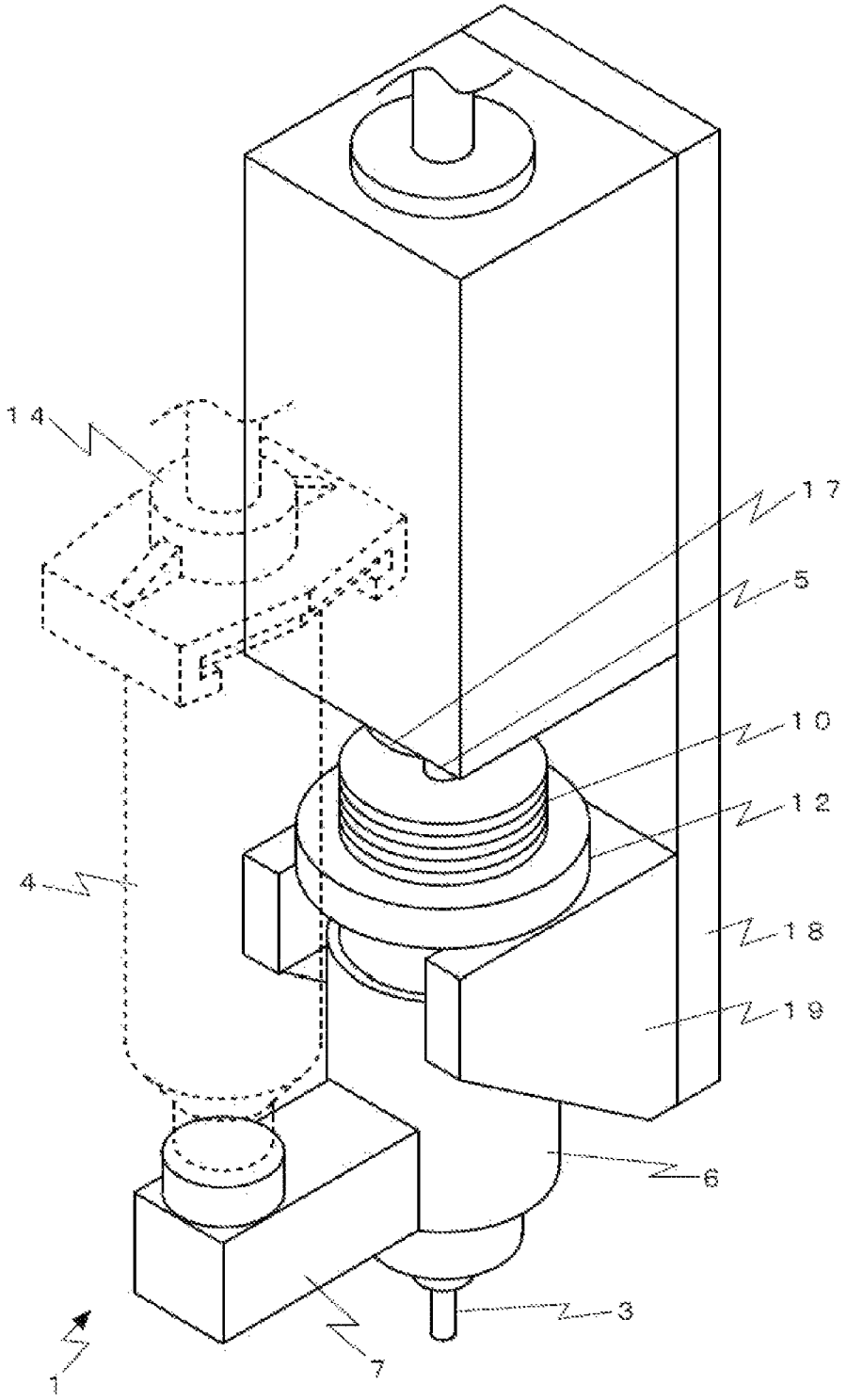
FIG. 1 is a schematic perspective view of a liquid material discharge apparatus according to a first embodiment.
Figure 2:
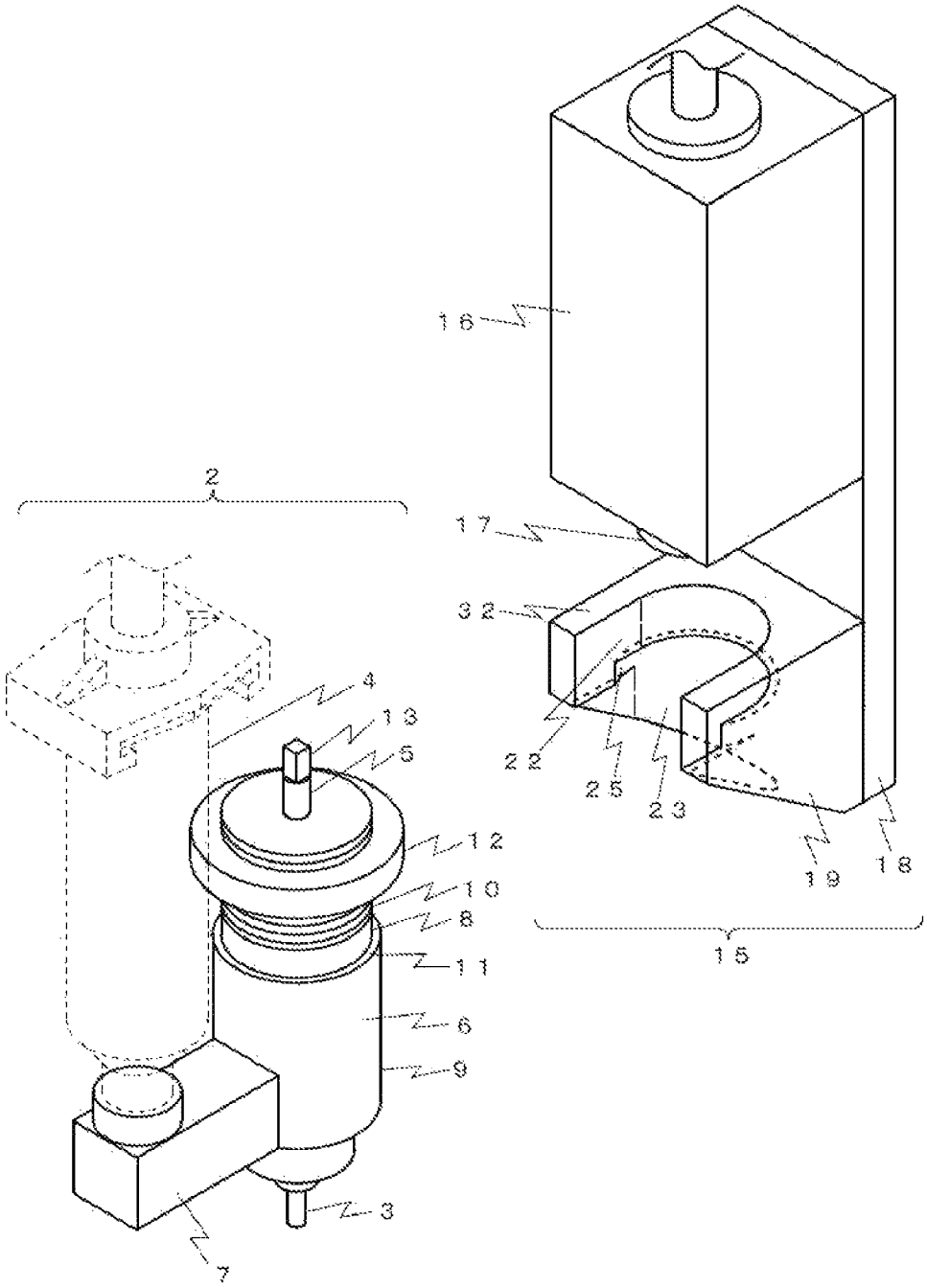
FIG. 2 is a schematic perspective view representing a state where a liquid contact unit is detached from a main body unit in the liquid material discharge apparatus according to the first embodiment.
Figure 3:
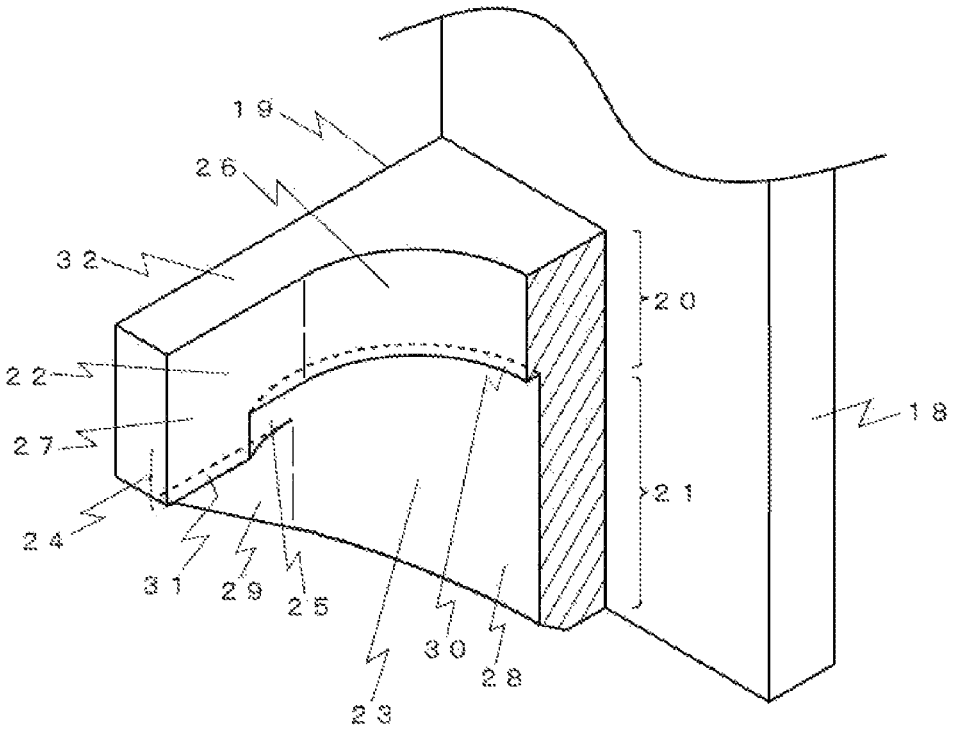
FIG. 3 is a perspective view representing a section of a holder in the liquid material discharge apparatus according to the first embodiment.

FIG. 1 is a schematic perspective view of a liquid material discharge apparatus 1 according to a first embodiment. FIG. 2 is a schematic perspective view representing a state where a liquid contact unit 2 is detached from a main body unit 15 in the liquid material discharge apparatus 1 according to the first embodiment. FIG. 3 is a perspective view representing a section of a holder 19 in the liquid material discharge apparatus 1 according to the first embodiment. In FIGS. 1 and 2, a storage container 4 is depicted by dotted lines for easier understanding of positional relations among overlapped members.

The following description is made about a liquid material discharge apparatus of screw type, for example. For convenience of explanation, the side nearer to a drive unit 16 is called the "upper side", the side nearer to a nozzle 3 is called the "lower side", the side nearer to a base 18 is called the "inner side", and the side nearer to the storage container 4 is called the "front side" in some cases.

The liquid material discharge apparatus 1 according to the first embodiment is mainly constituted by the liquid contact unit 2 and the main body unit 15.

The liquid contact unit 2 includes the nozzle 3 through which a liquid material is discharged, the storage container 4 that is in the form of a syringe and that stores the liquid material, a screw 5, a housing 6, and an extended member 7. The nozzle 3, the storage container 4, and the screw 5 are integrally constituted with the aid of both the housing 6 and the extended member 7. A discharge flow path in communication with the nozzle 3 and the storage container 4 is formed inside the housing 6, and the screw 5 is inserted in the discharge flow path. The screw 5 is a discharge member for acting on the liquid material in the discharge flow path to be fed to the nozzle 3. The storage container 4 is mounted to the housing 6 through a mounting member. The mounting member in the first embodiment is the extended member 7 extending horizontally, and the storage container 4 is mounted to the housing 6 in a positional relation parallel to the housing 6. A shape of the mounting member through which the storage container 4 is mounted to the housing 6 is not limited to the illustrated one. In another example, the mounting member may extend obliquely downward from the storage container 4. A flow path is formed inside the extended member 7 to communicate the storage container 4 and the nozzle 3 with each other via an extended flow path and the discharge flow path, which are both formed inside the housing 6. An adaptor tube 14 for connection with a tubing line through which compressed gas is supplied is mounted to the storage container 4 on the side opposite to the extended member 7.

The housing 6 has a circular-columnar shape in its entirety. More specifically, the housing 6 has a shape defined by two different circular columns that are joined to each other in a lengthwise direction. As illustrated in FIG. 2, an upper housing portion 8 has a smaller diameter than a lower housing portion 9, and includes a thread zone 10 formed in its outer circumference. Because of a difference in diameter between the upper housing portion 8 and the lower housing portion 9, an upper end of the lower housing portion 9 forms a shoulder 11. A locknut 12, i.e., a movable member having a role to fix the liquid contact unit 2 to the holder 19, is engaged with the thread zone 10. The locknut 12 is a disk-shaped round nut having a through-hole formed at a center, and at least a bottom surface of the locknut 12 is flat. However, a shape of the locknut 12 is not limited to the disk-like shape and may be optionally selected insofar as the locknut 12 is movable in an up-down direction while the locknut 12 remains fitted to the upper housing portion 8. Thus, the locknut 12 may be, for example, a polygonal nut such as a square nut or a hexagonal nut, a gear-shaped nut, a butterfly nut having a pair of wings, or a nut having a shape defined by 3 to 8 rounded projections that are radially arranged at equal intervals (namely, a nut having a shape like a tap handle). A lateral peripheral surface of the locknut 12 may be subjected to mechanical processing, such as knurling or sand blasting, or may be coated (surface-treated) with resin or rubber, for example.

The locknut 12 fixes the liquid contact unit 2 to the main body unit 15 in a state where the locknut 12 is contacted with an upper holder surface 32, and where an upper holder portion 20 is gripped between the housing shoulder 11 and the locknut 12 in a sandwiched relation. The locknut 12 is rotatable relative to the housing thread zone 10, and the housing 6 (i.e., the liquid contact unit 2) can be vertically movable by rotating the locknut 12 to vertically move in the state where the housing 6 is attached to the holder 19. It is here just needed for the thread zone 10 to have a length allowing the locknut 12 to reliably perform the attachment/detachment without being disengaged from the thread zone 10. The thread zone 10 may be formed in a required length, by way of example, as described in the first embodiment (see FIGS. 4 and 5). Alternatively, the thread zone 10 may be formed over the entirety of the upper housing portion 8.

The screw 5 serving as the discharge member is a rod-like member having a spiral blade (not illustrated), and it includes, in an end portion on the upper side (i.e., on the side nearer to the drive unit 16), a shaft end 13 having lateral surfaces that are chamfered over a certain length. A connection hole 33 having a shape in match with a sectional shape of the shaft end 13 is formed in a coupling member 17. By fitting the chamfered shaft end 13 into the connection hole 33, the discharge member 5 and the drive unit 16 can be coupled to each other without using any parts to be fastened and unfastened, e.g., screw nails, such that motive power can be transmitted. While the shaft end 13 is formed in a rectangular section in the example illustrated in FIG. 2, the sectional shape of the shaft end 13 is not limited to the illustrated example and may be a polygonal shape, such as a hexagonal shape, or a shape resulting from cutting part of a circle along a flat plane (i.e., a shape of a segment of a circle). In other words, the shaft end 13 (or the connection hole 33) is just needed to have a shape having at least one flat surface (practical forms of the connection hole 33 are described in detail in Japanese Patent No. 5089969 (Patent Reference 4), which discloses the invention proposed by the applicant).

The main body unit 15 includes the drive unit 16 provided with a motor for actuating the discharge member 5, a coupling 17 that is a coupling member for transmitting motive power of the motor to the discharge member 5, the base 18, and the holder 19 to which the housing 6 is detachably attached. The drive unit 16 positioned on the upper side and the holder 19 positioned on the lower side are integrally mounted to the base 18 with a certain distance kept between them.

Details of the holder 19 are described below with reference to FIG. 3. The holder 19 in the first embodiment is a single member having a U-shape when viewed from above, and it is mainly constituted by the upper holder portion 20 and a lower holder portion 21.

The upper holder portion 20 has a pair of support arms extending parallel to each other, and an inner lateral surface of the pair of support arms has a U-shape. The U-shaped inner lateral surface of the upper holder portion 20 is formed by an upper curved region 26 positioned on the inner side of the U-shape, and by a pair of upper flat regions 27 that are positioned on the front side of the U-shape. The pair of upper flat regions 27 are each defined by a flat plane having an L-shape when viewed from a side. The upper curved region 26 is formed in a shape (circular-arc shape) following an outer lateral surface of the upper housing portion 8 (specifically the housing thread zone 10), and has a semi-circular shape when viewed from above. A distance between the pair of support arms constituting the upper holder portion 20 (i.e., a distance between the two upper flat regions 27 formed on the front side of the upper curved region 26) is set to a length that is substantially the same as the diameter of the upper housing portion 8. The upper flat regions 27 are each constituted by an upper holder-portion inner surface 22 that is defined by a relatively large rectangular surface constituting one part of the L-shape, and an extended surface 24 that is defined by a relatively small rectangular surface constituting the remaining part of the L-shape. The extended surface 24 is connected to a lower holder-portion inner surface 23 through a connecting surface 25 that defines a curved surface in a circular-arc shape.

The lower holder-portion inner surface 23 defined by a U-shaped curved surface is formed as the U-shaped lateral surface of the lower holder portion 21. The lower holder-portion inner surface 23 has a lower curved region 28 on the inner side of the U-shape, and lower flat regions 29 positioned at opposite sides of the lower curved region 28 on the front side of the U-shape and each having a triangular shape when viewed from a side. The lower curved region 28 and the lower flat regions 29 constitute the pair of support arms extending parallel to each other. The lower curved region 28 is formed in a shape (circular-arc shape) following an outer lateral surface of the lower housing portion 9, and has a semi-circular shape when viewed from below. The connecting surface 25 connected to the lower holder-portion inner surface 23 is also formed in a circular-arc shape following the shape of the lower housing portion 9. A distance between the two lower flat regions 29 formed on the front side of the lower curved region 28 is set to a length that is substantially the same as the diameter of the lower housing portion 9. Stated in another way, because the distance between the pair of support arms constituting the upper holder portion 20 is smaller than the width of the lower housing portion 9 and the distance between the pair of support arms constituting the lower holder portion 21 is larger than the width of the lower housing portion 9, the lower housing portion 9 can be fitted to the lower holder portion 21, but it cannot be fitted to the upper holder portion 20.

The upper curved region 26 and the upper flat regions 27, which constitute an inner peripheral surface of the upper holder portion 20 including the pair of support arms, are formed in a circular-arc shape having a relatively small diameter and following the outer lateral surface of the upper housing portion 8. On the other hand, the lower curved region 28 and the lower flat regions 29, which constitute an inner peripheral surface of the lower holder portion 21 positioned under the pair of support arms, are formed in a circular-arc shape having a relatively large diameter and following the outer lateral surface of the lower housing portion 9. Thus, the upper curved region 26 receiving the smaller-diameter upper housing portion 8 and the lower curved region 28 receiving the larger-diameter lower housing portion 9 are different in diameter, and a step difference is formed between the upper holder portion 20 and the lower holder portion 21. A lower surface defining the above step difference (i.e., a lower surface of the upper holder portion 20) constitutes a boundary surface A 30. The boundary surface A 30 is contiguous with respective upper ends of the lower curved region 28 and the connecting surface 25 of the holder 19, and has a width gradually narrowing in a region near its end position where the connecting surface 25 and the extended surface 24 are contiguous with each other.

A step difference is also formed between the upper flat regions 27 and the lower flat regions 29. A lower surface defining the above step difference (i.e., a lower surface of the upper holder portion 20) constitutes a boundary surface B 31. The boundary surface B 31 is contiguous with an upper end of the lower flat regions 29 of the holder 19, and has a width gradually narrowing in a region near its end position where the lower flat region 29 and the lower curved region 28 are contiguous with each other.

A holder upper surface 32 is a flat surface formed at an upper end of the upper holder portion 20. The holder upper surface 32 supports the locknut 12 mounted to the housing 6, whereby the liquid contact unit 2 can be prevented from falling.

A vertical width of the connecting surface 25 (or the extended surface 24) is set to a length that is not smaller than a depth of the connection hole 33 in the coupling member 17 (or not smaller than a length of the chamfered shaft end 13), thus allowing the liquid contact unit 2 to be reliably attached and detached. There are no length limitations on respective vertical widths of the upper holder portion 20 and the lower holder portion 21. It is just required that the upper holder portion 20 has a length about a half the overall length of the upper housing portion 8, and that the lower holder portion 21 has a length about ⅔ of the overall length of the lower housing portion 9. In other words, the lengths of the upper holder portion 20 and the lower holder portion 21 are just required to be set to such lengths that those portions can guide the housing 6 when the housing 6 is moved up and down.

The holder 19 may include a pin that is disposed in an innermost region of the lower holder-portion inner surface 23 (i.e., an innermost part of the lower curved region 28) to project toward the front side, and the housing 6 may include, at a position opposing the pin, an elongate groove (having a length substantially equal to a distance by which the housing 6 is moved up and down) to which the pin is fitted. With such a structure, the housing 6 can be prevented from rotating within the holder 19 (in the same direction as that of the rotation of the locknut 12). As a result, the storage container 4 can be more accurately positioned to face the front.

<Application Apparatus>

Figure 9:
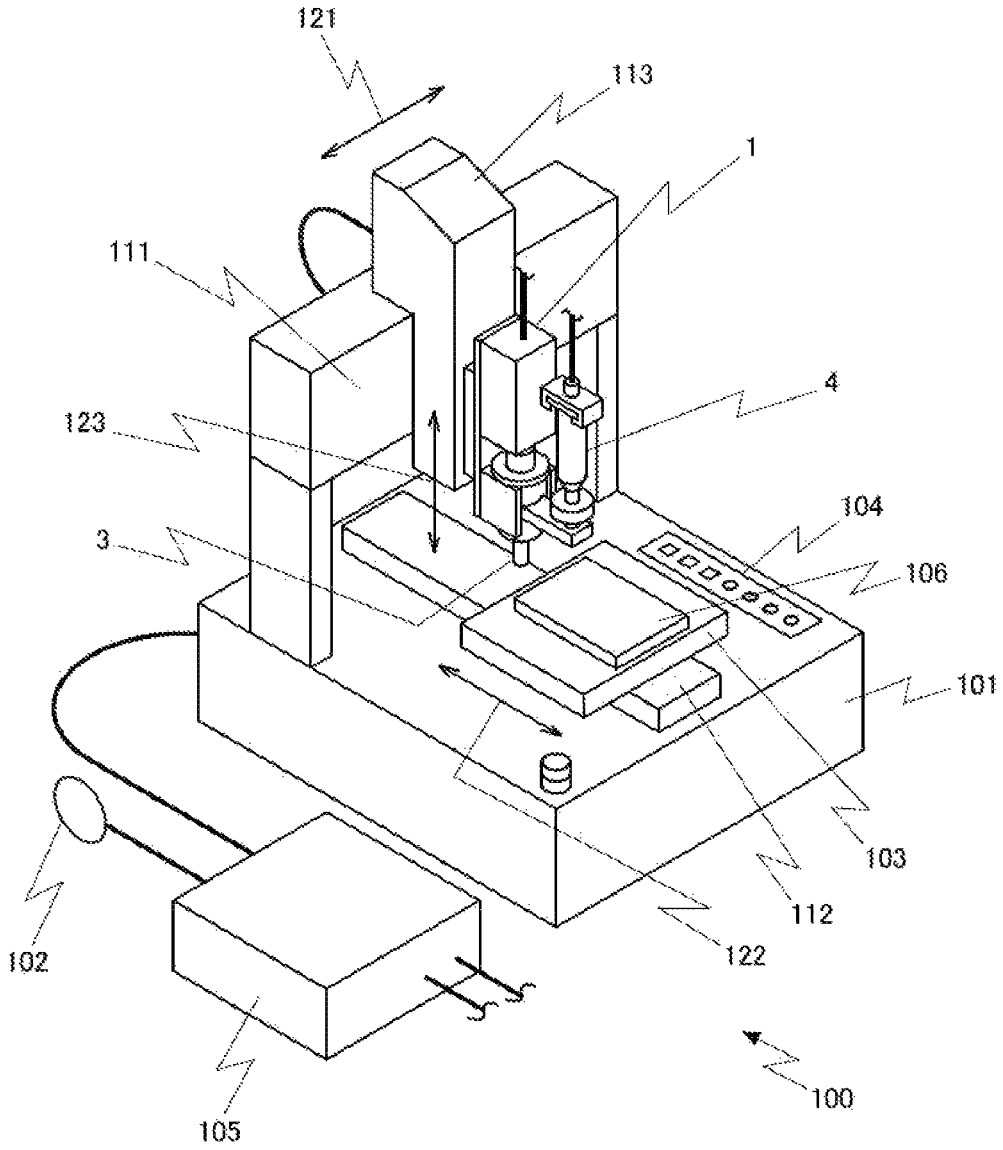
FIG. 9 is a perspective view of an application apparatus including the liquid material discharge apparatus according to the first embodiment.

The liquid material discharge apparatus 1 is mounted to a desktop application apparatus 100 as illustrated in FIG. 9, and is used in work of applying the liquid material onto a workpiece 106 by relatively moving the discharge apparatus 1 and a worktable 103 with operation of XYZ-axis drivers (111, 112 and 113). The illustrated application apparatus 100 includes a bench 101, the worktable 103 on which the workpiece 106, i.e., an application target, is placed, the X driver 111 for relatively moving the liquid material discharge apparatus 1 and the worktable 103 in an X direction 121, the Y driver 112 for relatively moving the liquid material discharge apparatus 1 and the worktable 103 in a Y direction 122, the Z driver 113 for relatively moving the liquid material discharge apparatus 1 and the worktable 103 in a Z direction 123, a dispense controller (discharge control unit) 105 that controls the operation of the liquid material discharge apparatus 1, and a drive control unit (not illustrated) that controls the operations of the XYZ drivers (111, 112 and 113).

The dispense controller 105 supplies compressed gas from a compressed gas source 102 to the storage container 4 under desired conditions. Operation buttons 104 are disposed on an upper surface of the bench 101.

The XYZ drivers include, for example, XYZ-axis servo motors and ball screws both known in the art, and can move a discharge port of the liquid material discharge apparatus 1 to a desired position on the workpiece at a desired speed. The operations of the XYZ drivers are controlled by the control unit.

As a matter of course, the liquid material discharge apparatus 1 of the present invention can be applied to not only the desktop application apparatus, but also to application apparatuses other than the desktop type.

<Detachment Procedure>

Procedures of detaching and attaching the liquid contact unit 2 in the liquid material discharge apparatus 1 according to the first embodiment will be described below. In the following description, an operation of rotating the locknut 12 to move the housing 6 upward is called "fastening", and an operation of rotating the locknut 12 to move the housing 6 downward is called "loosening" in some cases.

The procedure of detaching the liquid contact unit 2 from the main body unit 15 is described with reference to FIGS. 4, 5 and 6.

Figure 4:
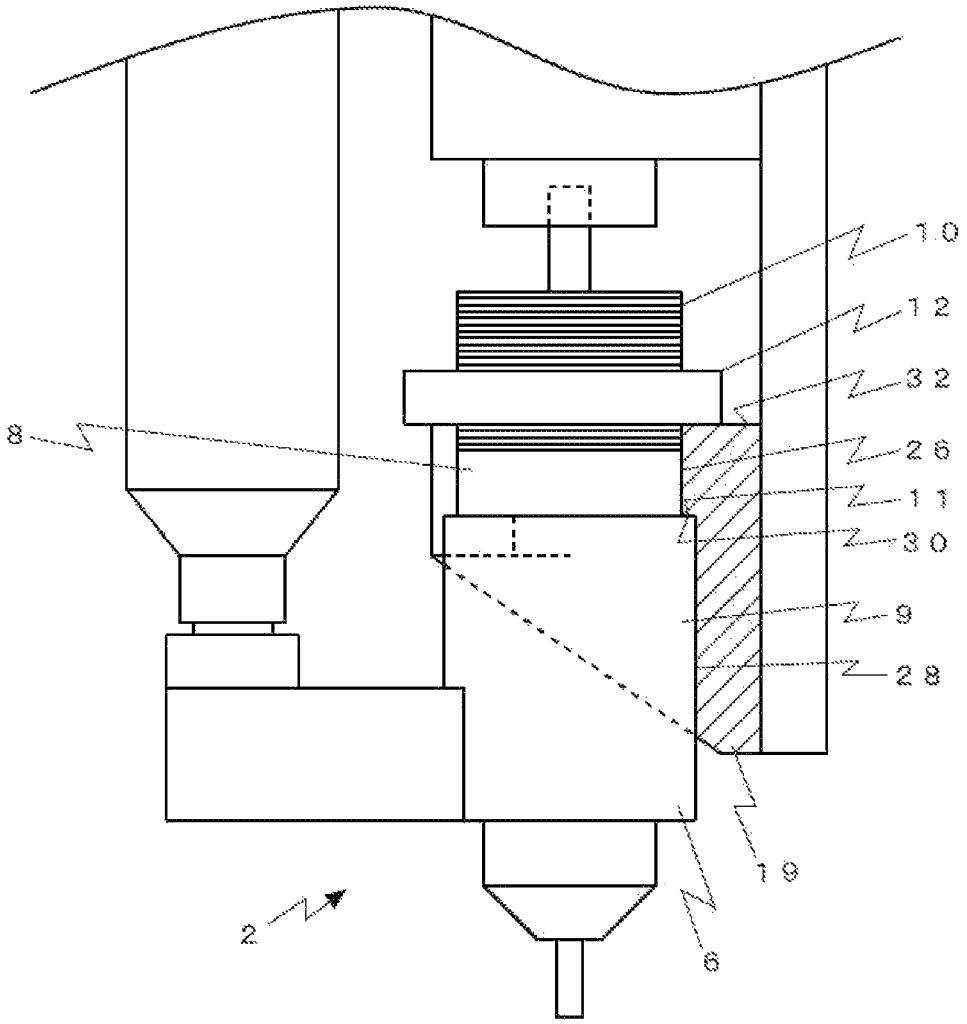
FIG. 4 is a partial sectional view referenced to explain attachment/detachment procedures for the liquid contact unit in the liquid material discharge apparatus according to the first embodiment, the view representing a state where the liquid contact unit is fixed.
Figure 5:
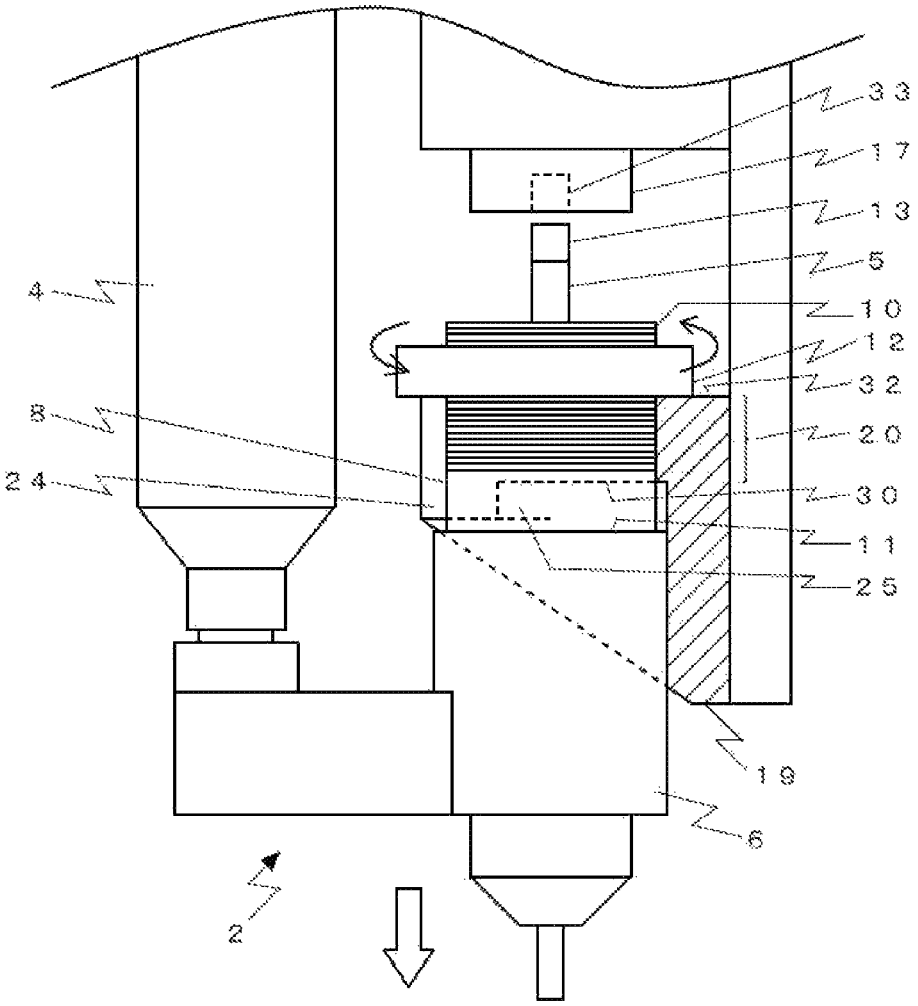
FIG. 5 is a partial sectional view referenced to explain the attachment/detachment procedures for the liquid contact unit in the liquid material discharge apparatus according to the first embodiment, the view representing a state where the housing is moved downward.

FIG. 4 is a partial sectional view referenced to explain the attachment/detachment procedures for the liquid contact unit 2 in the liquid material discharge apparatus 1 according to the first embodiment, the view representing a state where the liquid contact unit 2 is fixed to the main body unit 15. In that state where the liquid contact unit 2 is fixed, the holder upper surface 32 and a bottom surface of the locknut 12 are in contact with each other, and the boundary surface A30 and the housing shoulder 11 are in contact with each other. Stated in another way, the upper holder portion 20 is gripped by the locknut 12 and the housing 6 (specifically the lower housing portion 9) between them in a sandwiched relation. Because the locknut 12 is engaged with the thread zone 10 formed in the upper housing portion 8, the housing 6 is firmly fixed to the holder 19 by fastening the locknut 12. Furthermore, in the state where the liquid contact unit 2 is fixed, the upper housing portion 8 is in contact with the upper curved region 26 of the holder 19, and the lower housing portion 9 is in contact with the lower curved region 28 of the holder 19. Thus, since the upper and lower portions (8 and 9) of the housing 6 are in contact with the curved surfaces (26 and 28) of the holder 19, respectively, positioning between the shaft end 13 of the discharge member 5 and the connection hole 33 of the coupling member 17 can be made just by fitting the housing 6 into a recessed portion of the holder 19 in the later-described attaching procedure. Moreover, the curved surfaces (26 and 28) of the holder 19 serve to guide the housing 6 when the housing 6 is moved up and down.

When the locknut 12 is rotated to be loosened from the state of FIG. 4, the housing 6, the storage container 4, etc. are moved downward with the action of the thread zone 10 formed in the upper housing portion 8, while the locknut 12 remains in contact with the holder upper surface 32. At that time, since the locknut 12 is supported by the holder upper surface 32, falling of the housing 6 (i.e., the liquid contact unit 2) is avoided. With the downward movement of the housing 6, the boundary surface A 30 of the holder 19 and the housing shoulder 11 are departed away from each other, and force of gripping the upper holder portion 20 in the sandwiched relation is weakened. Hence the housing 6 is released from the state fixed to the main body unit 15. After further rotating the locknut 12 to move the housing 6 downward through a distance larger than the vertical width of the connecting surface 25 (or the extended surface 24), the operation of loosening the locknut 12 is stopped (FIG. 5). In that state, the shaft end 13 of the discharge member 5 is disengaged from the connection hole 33 of the coupling member 17, and the shoulder 11 is positioned at a lower level than the boundary surface B 31. Here, in order to prevent the locknut 12 from being disengaged from the thread zone 10 and to avoid the housing 6 from being fallen accidentally, the length of the thread zone 10 is preferably set such that a distance G between an upper end of the thread zone 10 and an upper end of the locknut 12 can be surely provided as a sufficient value in a stage where the shoulder 11 is positioned at a lower level than the boundary surface B 31 (for example, the distance G is set to be 1 to 5 times the vertical width of the connecting surface 25 (or the extended surface 24)).

Figure 6:
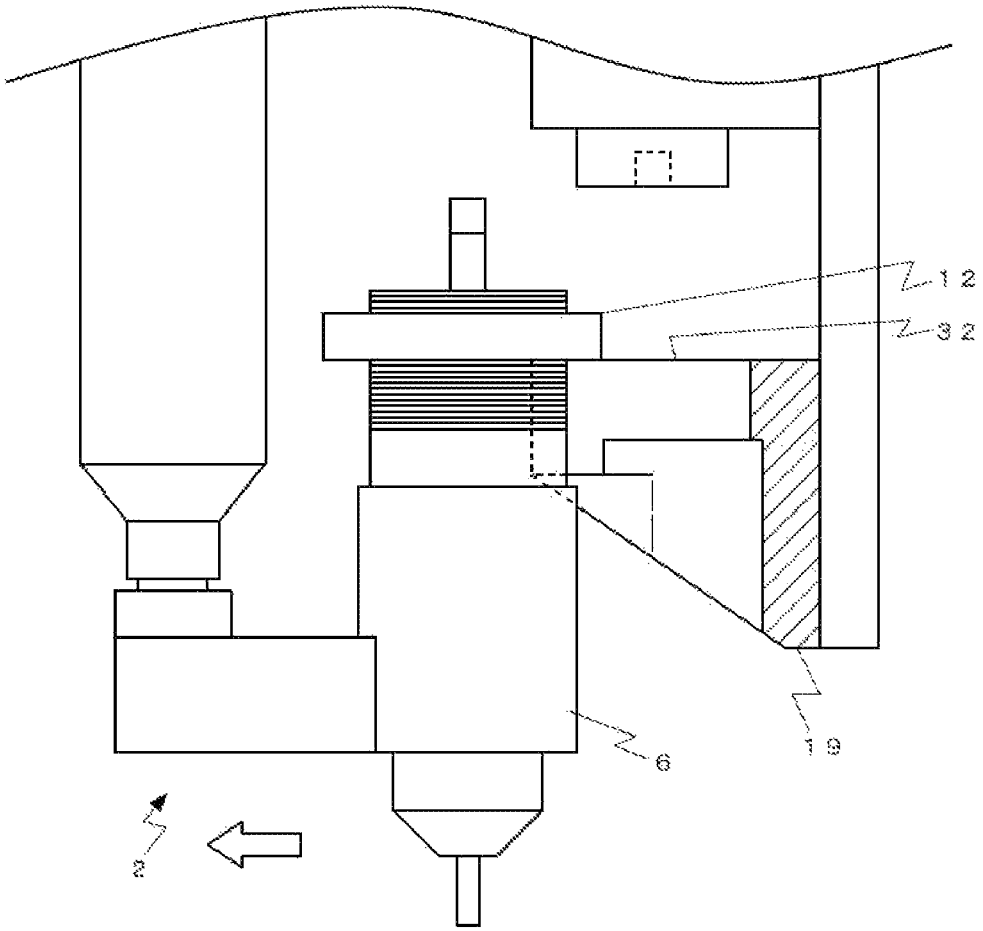
FIG. 6 is a partial sectional view referenced to explain the attachment/detachment procedures for the liquid contact unit in the liquid material discharge apparatus according to the first embodiment, the view representing a state where the liquid contact unit is going to be separated off from a holder.

After moving the housing 6, released from the state fixed to the main body unit 15, downward through the distance larger than the vertical width of the connecting surface 25 (or the extended surface 24) (i.e., in the state of FIG. 5), the housing 6 (i.e., the liquid contact unit 2) is moved toward the front (namely, in a direction away from the curved surfaces (26 and 28)) to be detached from the holder 19 (FIG. 6). On that occasion, since the locknut 12 is supported by the holder upper surface 32, falling of the housing 6 (i.e., the liquid contact unit 2) is avoided.

Thus, the housing 6 (i.e., the liquid contact unit 2) can be released from the state fixed to the holder 19 and can be moved downward just by rotating the locknut 12 in a loosening direction. Furthermore, since the locknut 12 is engaged with the thread zone 10 formed in the housing 6 and the locknut 12 is supported by the holder upper surface 32, it is possible not only to prevent falling of the liquid contact unit 2, but also to reduce the overall width of the apparatus 1. Moreover, in the first embodiment, since the width of the locknut 12 is set to be not larger than that of the holder 19 (more specifically, not larger than that of the main body unit 15 in a left-right direction), further reduction of the overall width is realized (note that setting the width of the locknut 12 to be not larger than that of the holder 19 is not an essential factor, and that the above-described problem can also be solved in the case of setting the width of the locknut 12 to be somewhat larger than that of the holder 19).

<Attachment Procedure>

Figure 7:
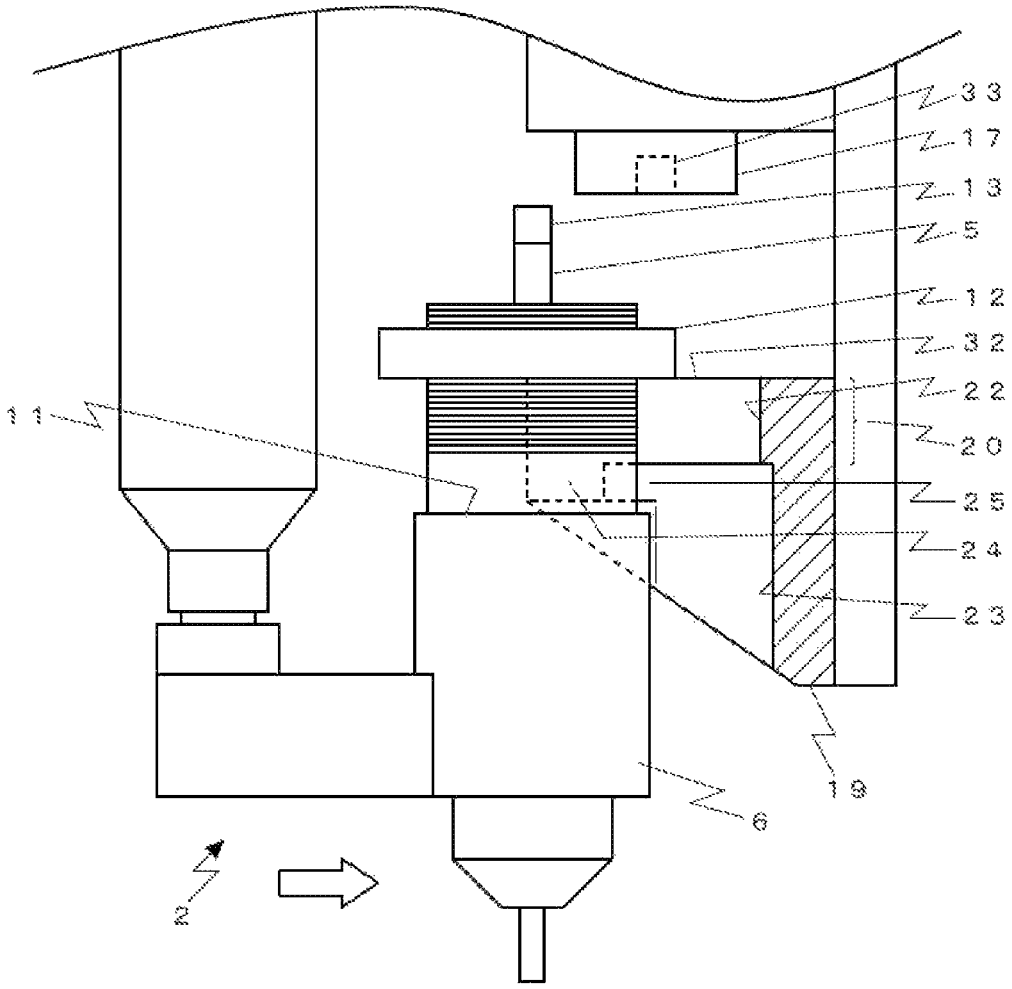
FIG. 7 is a partial sectional view referenced to explain the attachment/detachment procedures for the liquid contact unit in the liquid material discharge apparatus according to the first embodiment, the view representing a state where the liquid contact unit is going to be fitted to the holder.

The procedure of attaching the liquid contact unit 2 to the main body unit 15 is described with reference to FIGS. 7, 8 and 4.

After maintenance work such as refilling of the liquid material and washing of the flow paths, the position of the locknut 12 in the liquid contact unit 2 (i.e., the distance between the housing shoulder 11 and the locknut 12) is adjusted. Here, the position of the locknut 12 is adjusted to make the distance between the position of the locknut 12 and the shoulder 11 larger than the vertical width of the upper flat region 27, and to prepare such a situation as allowing the lower housing portion 9 to come into a space under the boundary surface B 31. Then, the liquid contact unit 2 is inserted into the recessed portion of the holder 19 and attached thereto while the bottom surface of the locknut 12 is placed on the holder upper surface 32 (FIG. 7). At that time, the holder upper surface 32 supports the locknut 12 and prevents falling of the housing 6 (i.e., the liquid contact unit 2) with which the locknut 12 is engaged.

The positioning between the shaft end 13 of the discharge member 5 and the connection hole 33 of the coupling member 17 is made by inserting the housing 6 up to a position where the upper housing portion 8 and the lower housing portion 9 abut respectively against the innermost parts of the upper curved region 26 and the lower curved region 28. In that state, the curved surfaces (26 and 28) of the holder 19 are located at positions where they guide the housing 6 when the housing 6 is moved up and down.

Figure 8:
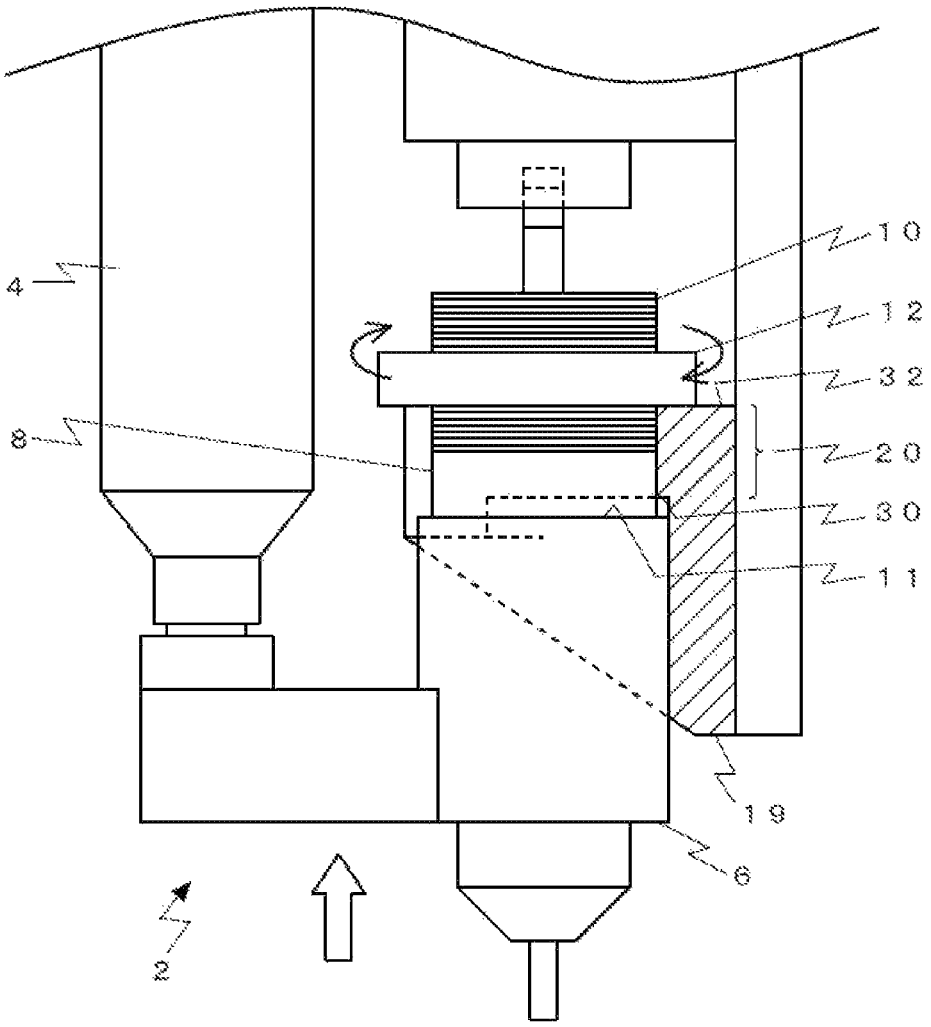
FIG. 8 is a partial sectional view referenced to explain the attachment/detachment procedures for the liquid contact unit in the liquid material discharge apparatus according to the first embodiment, the view representing a state where the housing is moved upward.

By rotating the locknut 12 in a fastening direction from the state where the housing 6 is abutted against the holder 19, the housing 6, the storage container 4, etc. are moved upward due to the action of the thread zone 10 formed in the upper housing portion 8, while the locknut 12 remains in contact with the holder upper surface 32 (FIG. 8). At that time, since the locknut 12 is supported by the holder upper surface 32, falling of the housing 6 (i.e., the liquid contact unit 2) is avoided. With further upward movement of the housing 6, the boundary surface A 30 of the holder 19 and the housing shoulder 11 come into contact with each other, thereby gripping the upper holder portion 20 in a sandwiched relation to be fixed to the main body unit 15 (i.e., the state of FIG. 4).

With the liquid material discharge apparatus 1 according to the first embodiment, as described above, since the housing 6 can be fixed to the holder 19 due to the action of the thread zone 10 just by rotating the locknut 12 in the fastening direction, even a first-time operator can easily attach the liquid contact unit 2 to the main body unit 15. Furthermore, since the detachment and the attachment are performed in the state where the locknut 12 is engaged with the thread zone 10 formed in the housing 6 and where the locknut 12 is supported by the holder upper surface 32, falling of the liquid contact unit 2 can be prevented with very high reliability. Moreover, since the smaller-diameter portion of the liquid contact unit 2 is held by the holder 19, the overall width of the apparatus 1 can be reduced. Additionally, since the housing 6 is fixed with the aid of the locknut 12 that is neither fastened nor unfastened in the attachment/detachment operations, damages of the workpiece, etc. can be prevented which may occur due to falling of screw nails, tools, and so on.

Second Embodiment

Figure 10:
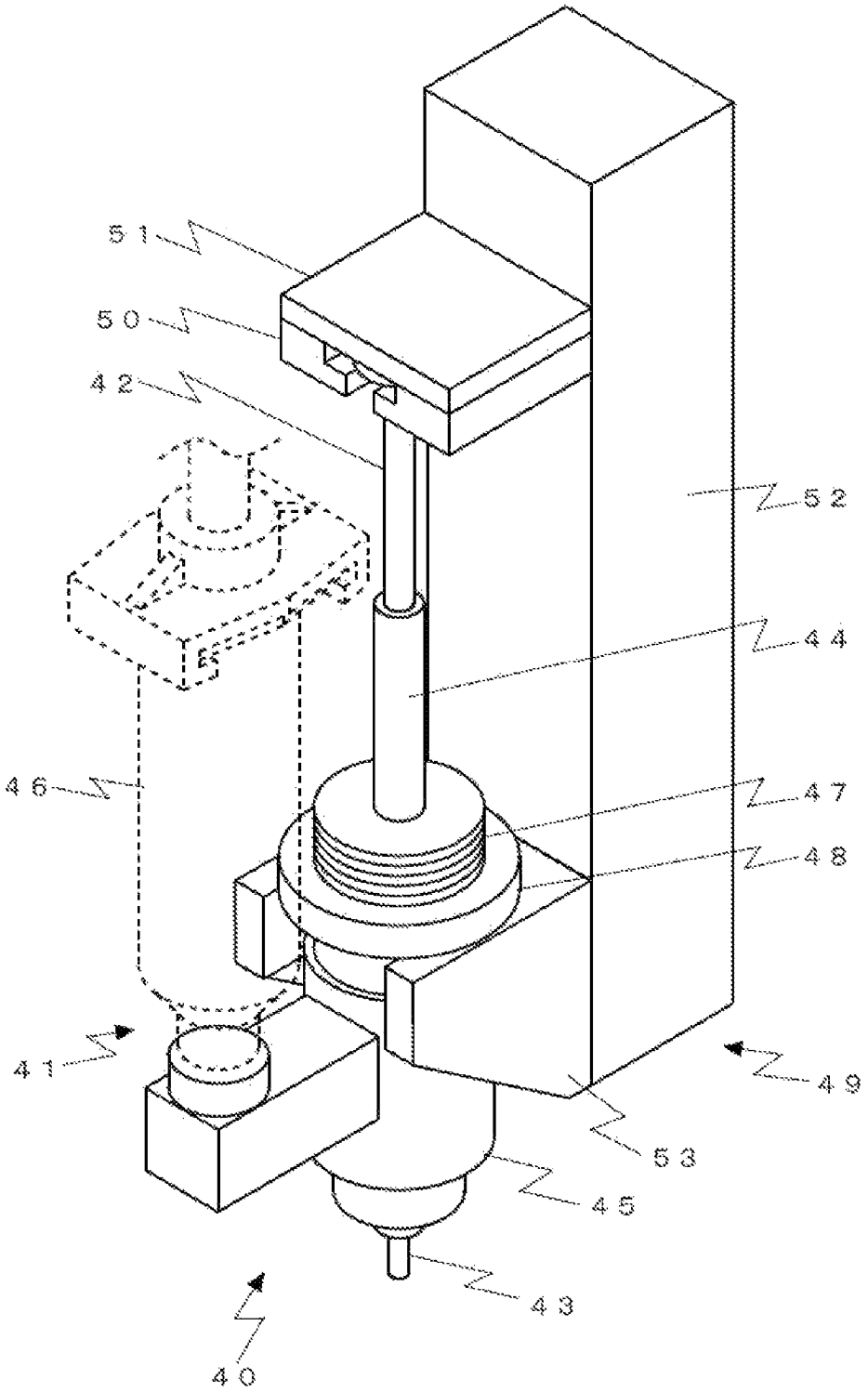
FIG. 10 is a schematic perspective view of a liquid material discharge apparatus according to a second embodiment.

FIG. 10 is a schematic perspective view of a liquid material discharge apparatus 40 according to a second embodiment.

The liquid material discharge apparatus 40 according to the second embodiment is the plunger type of discharging the liquid material by moving, through a desired distance, a plunger 42 that slides reciprocally in a state closely contacting an inner surface of a metering portion 44 that includes a nozzle 43 disposed at a tip end. As in the first embodiment, the liquid material discharge apparatus 40 is mainly constituted by a liquid contact unit 41 and a main body unit 49.

The liquid contact unit 41 includes the plunger 42 serving as a discharge member, the metering portion 44 that accommodates the plunger 42, the nozzle 43 through which the liquid material is discharged, a housing 45 to which the metering portion 44 and the nozzle 43 are fixed, and a storage container 46 that stores the liquid material.

The main body unit 49 includes a drive unit 52 in which a plunger moving member 50 for moving the plunger 42 back and forth is disposed, and a holder 53 that holds the housing 45. A plate-like member having a large diameter is disposed at an upper end of the plunger 42, and the plunger 42 is fixed to a recessed portion of the plunger moving member 50 in a state where the plate-like member is sandwiched between the plunger moving member 50 and a plunger fixing member 51.

As in the first embodiment, the housing 45 is configured such that a thread zone 47 is formed in an upper housing portion having a circular columnar shape and a locknut 48 is engaged with the thread zone 47. The holder 53 also has a similar configuration to that in the first embodiment. In the second embodiment as well, since the upper housing portion has a smaller width than a lower housing portion and the upper housing portion having the smaller width is held by the holder 53, an overall width of the apparatus can be reduced.

In addition, attachment and detachment methods are similar to those in the first embodiment. The liquid material discharge apparatus 40 according to the second embodiment can also be mounted to an application apparatus including XYZ drivers in practical use.

Third Embodiment

Figure 11:
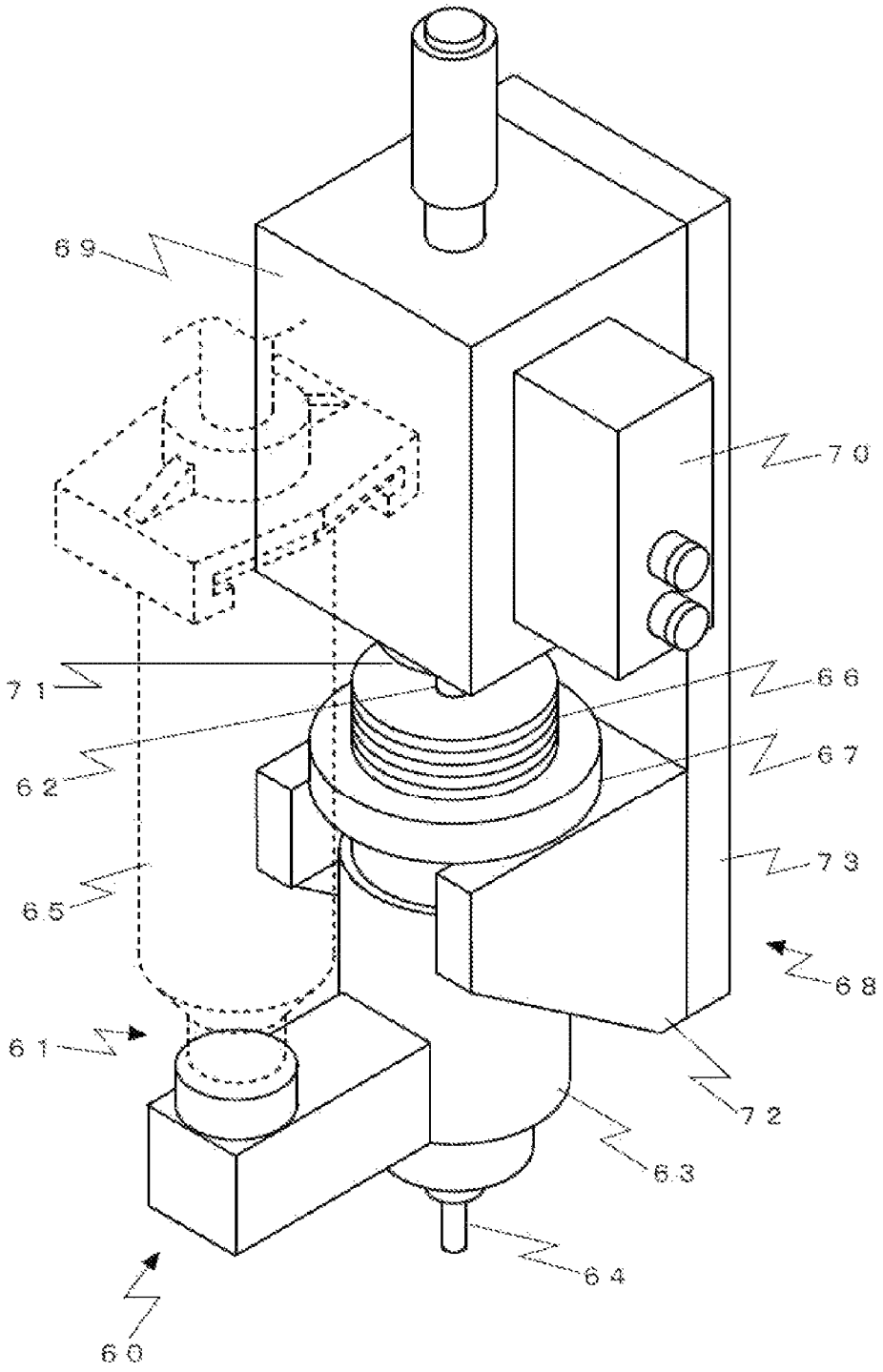
FIG. 11 is a schematic perspective view of a liquid material discharge apparatus according to a third embodiment.

FIG. 11 is a schematic perspective view of a liquid material discharge apparatus 60 according to a third embodiment.

The liquid material discharge apparatus 60 according to the third embodiment is the jet type of striking a valve member 62 against a valve seal and discharging the liquid material in a state flying from a tip end of a nozzle 64. As in the first embodiment, the liquid material discharge apparatus 60 is mainly constituted by a liquid contact unit 61 and a main body unit 68. As a matter of course, the technical concept of the present invention can be further applied to the jet type not striking the valve member (plunger) against the valve seat unlike the third embodiment, namely to the jet type moving the valve member (plunger) and then stopping it abruptly, thus causing the liquid material to be discharged in a similar manner, i.e., in a state flying from the tip end of the nozzle.

The liquid contact unit 61 includes the valve member 62 serving as a discharge member, a housing 63 that accommodates the valve member 62, the nozzle 64 through which the liquid material is discharged, and a storage container 65 that stores the liquid material.

The main body unit 68 includes a drive unit 69 including an air chamber, a spring chamber, and a switching valve 70 that switches over supply of air to the air chamber, a chuck 71 serving as a coupling member that couples the drive unit 69 and the valve member 62 to each other, a holder 72 that holds the housing 63, and a base 73 to which the drive unit 69 and the holder 72 are mounted with a certain spacing maintained between them.

As in the first embodiment, the housing 63 is configured such that a thread zone 66 is formed in an upper housing portion having a circular columnar shape and a locknut 67 is engaged with the thread zone 66. The holder 72 also has a similar configuration to that in the first embodiment. In the third embodiment as well, since the upper housing portion has a smaller width than a lower housing portion and the upper housing portion having the smaller width is held by the holder 72, an overall width of the apparatus can be reduced.

In addition, attachment and detachment methods are similar to those in the first embodiment. The liquid material discharge apparatus 60 according to the third embodiment can also be mounted to an application apparatus including XYZ drivers in practical use.

Fourth Embodiment

Figure 12:
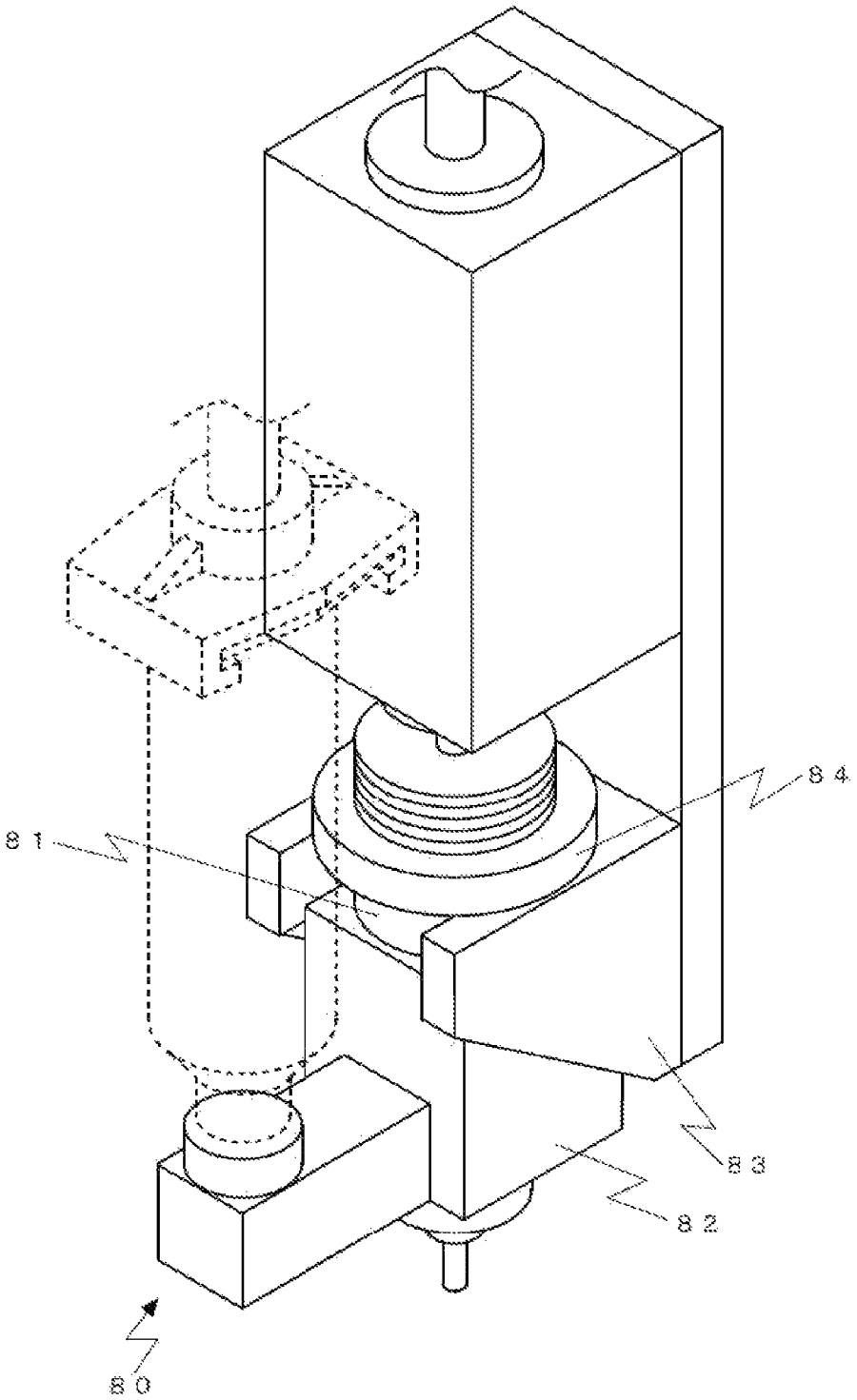
FIG. 12 is a schematic perspective view of a liquid material discharge apparatus according to a fourth embodiment.

FIG. 12 is a schematic perspective view of a liquid material discharge apparatus 80 according to a fourth embodiment.

The liquid material discharge apparatus 80 according to the fourth embodiment is different from the liquid material discharge apparatus according to the first embodiment in that a lower housing portion 82 has a rectangular parallelepiped shape instead of a circular columnar shape. An upper housing portion 81 has a circular columnar shape for engagement with a locknut 84.

A lower inner surface of the holder 83 is constituted by, without including curved surfaces, only flat surfaces in match with the shape (rectangular parallelepiped shape) of the lower housing portion 82. Therefore, it is not needed, unlike the first embodiment, to form the connecting surface 25 that connects the extended surface 24 and the lower holder-portion inner surface 23 to each other. In the fourth embodiment as well, since the upper housing portion has a smaller width than the lower housing portion and the upper housing portion having the smaller width is held by the holder 83, an overall width of the apparatus can be reduced.

Attachment and detachment methods are similar to those in the first embodiment. The liquid material discharge apparatus 80 according to the fourth embodiment can also be mounted to an application apparatus including XYZ drivers in practical use.

In the fourth embodiment, since the lower housing portion 82 has the rectangular parallelepiped shape, the storage container can be easily and accurately positioned to face the front.

LIST OF REFERENCE SIGNS

1: discharge apparatus, 2: liquid contact unit, 3: nozzle, 4: storage container (syringe), 5: discharge member (screw), 6: housing, 7: extended member, 8: upper housing portion, 9: lower housing portion, 10: thread zone, 11: shoulder, 12: locknut (movable member), 13: shaft end, 14: adaptor tube, 15: main body unit, 16: drive unit (motor), 17: coupling member (coupling), 18: base, 19: holder, 20: upper holder portion, 21: lower holder portion, 22: upper holder-portion inner surface, 23: lower holder-portion inner surface, 24: extended surface, 25: connecting surface, 26: upper curved region, 27: upper flat region, 28: lower curved region, 29: lower flat region, 30: boundary surface A, 31: boundary surface B, 32: the holder upper surface, 33: connection hole, 40: discharge apparatus (second embodiment), 41: liquid contact unit, 42: discharge member (plunger), 43: nozzle, 44: metering portion, 45: housing, 46: storage container, 47: thread zone, 48: locknut, 49: main body unit, 50: plunger moving member, 51: plunger fixing member, 52: drive unit, 53: holder, 60: discharge apparatus (third embodiment), 61: liquid contact unit, 62: discharge member (valve member), 63: housing, 64: nozzle, 65: storage container, 66: thread zone, 67: locknut, 68: main body unit, 69: drive unit, 70: switching valve, 71: coupling member (chuck), 72: holder, 73: base, 80: discharge apparatus (fourth embodiment), 81: upper housing portion, 82: lower housing portion, 83: holder, 84: locknut, 100: application apparatus, 101: bench, 102: compressed gas source, 103: worktable, 104: operation button, 105: dispense controller (discharge control unit), 106: workpiece, 111: X-axis driver, 112: Y-axis driver, 113: Z-axis driver, 121: X direction, 122: Y direction, 123: Z direction

The invention claimed is:

1. A liquid material discharge apparatus comprising:

a liquid contact unit provided with a housing including a nozzle and a discharge member, and with a storage container fluidly connected to the housing with the aid of a mounting member; and a main body unit provided with a holder to which the housing is detachably attached, and with a drive unit for actuating the discharge member that is detachably coupled to the drive unit, wherein the liquid material discharge apparatus further comprises a movable member being movable in an up-down direction along the housing while the movable member remains attached to the housing, and the discharge member and the drive unit are attachable and detachable with movement of the movable member in the up-down direction.

2. The liquid material discharge apparatus according to claim 1, wherein the housing includes a lower housing portion having a shoulder, and an upper housing portion having a smaller width than the lower housing portion, and the liquid contact unit is fixed to the main body unit with the movable member and the shoulder gripping the holder therebetween in a sandwiched relation.

3. The liquid material discharge apparatus according to claim 2, wherein the movable member is formed of a flat-plate member having a through-hole into which the upper housing portion is inserted.

4. The liquid material discharge apparatus according to claim 3, wherein a width of the movable member is not larger than a width of the holder.

5. The liquid material discharge apparatus according to claim 3, wherein an external thread zone is formed in an outer peripheral surface of the upper housing portion, an internal thread zone engageable with the external thread zone is formed in an inner peripheral surface of the through-hole of the movable member, and the discharge member and the drive unit are attachable and detachable with actions of the external and internal thread zones by rotating the movable member forward and backward.

6. The liquid material discharge apparatus according to claim 2, wherein the holder includes a pair of support arms, and a width of the movable member is larger than a distance between the pair of support arms.

7. The liquid material discharge apparatus according to claim 6, wherein the holder includes an upper holder portion and a lower holder portion, a spacing between the pair of support arms has a distance, at a position present in the upper holder portion, smaller than a width of the lower housing portion and a distance, at a position present in the lower holder portion, larger than the width of the lower housing portion, and the liquid contact unit is fixed to the main body unit with the movable member and the shoulder gripping the upper holder portion therebetween in a sandwiched relation.

8. The liquid material discharge apparatus according to claim 7, wherein each of the upper housing portion and the lower housing portion has a circular columnar shape, and the holder includes a connecting surface that has a circular-arc shape, and the connecting surface connects the upper holder portion and the lower holder portion to each other.

9. The liquid material discharge apparatus according to claim 2, wherein the lower housing portion has a rectangular-columnar shape.

10. An application apparatus comprising:

the liquid material discharge apparatus according to claim 1;

a compressed gas source that supplies compressed gas for applying pressure to a liquid stored in the storage container;

a discharge control unit that controls the drive unit of the liquid material discharge apparatus and gas pressure in the compressed gas source;

a worktable on which an application target is placed;

an XYZ drive mechanism that moves the liquid material discharge apparatus and the worktable relatively; and a drive control unit that controls operations of the XYZ drive mechanism.

11. An application apparatus comprising:

the liquid material discharge apparatus according to claim 2;

a compressed gas source that supplies compressed gas for applying pressure to a liquid stored in the storage container;

a discharge control unit that controls the drive unit of the liquid material discharge apparatus and gas pressure in the compressed gas source;

a worktable on which an application target is placed;

an XYZ drive mechanism that moves the liquid material discharge apparatus and the worktable relatively; and a drive control unit that controls operations of the XYZ drive mechanism.

* * * * *